US011654706B2

(12) United States Patent
Komolzew

(10) Patent No.: US 11,654,706 B2
(45) Date of Patent: May 23, 2023

(54) METHOD FOR PRINTING A SURFACE WITH A PRINTED PATTERN

(71) Applicant: Dr. Ing. h.c. F. Porsche Aktiengesellschaft, Stuttgart (DE)

(72) Inventor: Roman Komolzew, Gronau (DE)

(73) Assignee: Dr. Ing. h. c. F. Porsche AG, Stuttgart (DE)

( * ) Notice: Subject to any disclaimer, the term of this patent is extended or adjusted under 35 U.S.C. 154(b) by 383 days.

(21) Appl. No.: 16/776,567

(22) Filed: Jan. 30, 2020

(65) Prior Publication Data

US 2020/0238729 A1 Jul. 30, 2020

(30) Foreign Application Priority Data

Jan. 30, 2019 (DE) ..... 10 2019 102 247.9

(51) Int. Cl.

| | |
|---|---|
| ***B41M 3/00*** | (2006.01) |
| ***B41J 3/407*** | (2006.01) |
| ***B41M 7/00*** | (2006.01) |
| ***B05C 9/12*** | (2006.01) |
| ***B05C 5/02*** | (2006.01) |
| ***B41J 11/00*** | (2006.01) |

(Continued)

(52) U.S. Cl.

CPC ..... *B41M 3/00* (2013.01); *B05C 5/0208* (2013.01); *B05C 9/12* (2013.01); *B41J 3/4073* (2013.01); *B41J 11/00214* (2021.01); *B41J 11/00216* (2021.01); *B41M 7/0081* (2013.01); *B05D 3/0263* (2013.01); *B05D 3/065* (2013.01); *B41J 11/0015* (2013.01); *B41M 7/009* (2013.01)

(58) Field of Classification Search

CPC ..... B41M 3/00; B41M 5/011; B41M 7/00; B41M 7/0081; B41M 7/009; B41J 3/4073; B41J 11/0015; B41J 11/00214; B41J 11/00216; B05D 3/0263; B05D 3/065

USPC ..... 427/466, 508, 510, 511

See application file for complete search history.

(56) References Cited

U.S. PATENT DOCUMENTS

| | | | | |
|---|---|---|---|---|
| 6,849,308 | B1 * | 2/2005 | Speakman | G03F 7/16 427/512 |
| 8,628,177 | B2 * | 1/2014 | Barton | B41M 7/009 347/84 |

(Continued)

FOREIGN PATENT DOCUMENTS

| | | |
|---|---|---|
| CN | 101450559 | 6/2009 |
| CN | 105531122 | 4/2016 |

(Continued)

OTHER PUBLICATIONS

German Examination Report dated Oct. 31, 2019.
Chinese Search Report dated Apr. 16, 2021.
European Examination Report dated Jun. 17, 2022.

*Primary Examiner* — Brian K Talbot
(74) *Attorney, Agent, or Firm* — Gerald E. Hespos; Michael J. Porco

(57) ABSTRACT

A method for printing a surface (1) with a printed pattern (2) includes printing a first partial structure (3) of the printed pattern (2), printing a second partial structure (3) of the printed pattern (2) at a distance from the first printed structure (3) and treating at least one region (7) between the first printed structure (3) and the second printed structure (3), and the irradiating the region (7) between the first printed structure (3) and the second printed structure (3) with electromagnetic waves and/or soundwaves.

10 Claims, 1 Drawing Sheet

(51) Int. Cl.
*B05D 3/02* (2006.01)
*B05D 3/06* (2006.01)

(56) References Cited

U.S. PATENT DOCUMENTS

| | | | | |
|---|---|---|---|---|
| 2007/0062383 | A1* | 3/2007 | Gazeau | B33Y 30/00 101/35 |
| 2009/0145318 | A1 | 6/2009 | Hoynant et al. | |
| 2010/0221449 | A1 | 9/2010 | Schlatterbeck et al. | |
| 2011/0261127 | A1* | 10/2011 | Kovacs | B41M 7/0081 347/102 |
| 2012/0321816 | A1 | 12/2012 | Chopra et al. | |
| 2013/0052332 | A1* | 2/2013 | Roof | B41J 11/0024 427/466 |
| 2013/0335469 | A1 | 12/2013 | Saita et al. | |
| 2015/0042716 | A1* | 2/2015 | Beier | B25J 11/0075 347/14 |
| 2015/0138275 | A1* | 5/2015 | Noell | B41J 3/4073 347/37 |
| 2015/0210087 | A1 | 7/2015 | Fukumoto et al. | |
| 2016/0185127 | A1 | 6/2016 | Gloots et al. | |
| 2016/0185128 | A1* | 6/2016 | Cloots | B41J 3/4073 347/9 |

FOREIGN PATENT DOCUMENTS

| | | | |
|---|---|---|---|
| DE | 10 2007 034 866 | 1/2009 | |
| DE | 10 2012 208 487 | 12/2012 | |
| DE | 10 2014 221 103 | 12/2014 | |
| JP | 6399736 B2 * | 10/2018 | B05B 1/30 |

* cited by examiner

METHOD FOR PRINTING A SURFACE WITH A PRINTED PATTERN

CROSS REFERENCE TO RELATED APPLICATION

This application claims priority under 35 USC 119 to German Patent Appl. No. 10 2019 102 247.9 filed on Jan. 30, 2019, the entire disclosure of which is incorporated herein by reference.

BACKGROUND

Field of the Invention

The invention relates to a method for printing a surface with a printed pattern, in particular for printing onto a vehicle body. The method is carried out to include a smoothing of the regions between partial structures of the printed pattern during the printing operation. The invention also relates to an associated printing device.

Related Art

A known technology allows a pattern, such as rally stripes to be printed onto a vehicle body in a manner similar to a conventional printer. For example, DE 10 2014 221 103 A1 discloses a method for printing automobile bodies along multiple lines. Printing operations of this type use a printhead that prints two-dimensional patterns to be printed in individual strips of paint one behind the other or one under or over the other, in a manner similar to a conventional inkjet printer. The distance between the individual lines is chosen such that the paint between the lines runs in such a way that, after curing/drying of the paint, a continuous area of color is obtained. Unfortunately, finding the optimum distances between the strips is relatively difficult because the flow behavior of the paint is dependent on many parameters. If the distance between the printed strips is not set optimally, the individual strips may not be right up against one another and/or may run into one another too much and lead to the formation of overlapping regions. Both effects have an adverse impact on the quality of the printed pattern and therefore are to be avoided.

The invention relates to a printing method for achieving an optimum printing result.

SUMMARY

The invention relates to a method for printing a surface with a printed pattern. The method comprises printing a first partial structure of the printed pattern and printing a second partial structure of the printed pattern at a distance from the first printed structure. The method further comprises treating at least one region between the first printed pattern and the second printed pattern by irradiating the region with electromagnetic waves and/or soundwaves.

The method according to the invention can be used to apply paint to body parts of vehicles, for instance engine hoods or doors, and thus to produce printed patterns. The pattern to be printed is printed sequentially in partial structures, with the partial structures being printed one after the other at a distance from one another. The distance may be a few millimeters. The partial structures are not arranged right up against one another, thereby avoiding the already mentioned visible overlaps of the paint that often occur in the prior art and avoiding transitions between the strips that are not homogeneous. In the method of the invention, at least the region between the first partial structure and the second partial structure is treated by being exposed to electromagnetic radiation and/or soundwaves. The treated region between the first partial structure and the second partial structure may include marginal regions of the two partial structures lying against them. Thus, the method treats at least the region between the partial structures. In other words, in the method it is not intended to treat exclusively the region of the surface lying between the printed partial structures, but also the marginal regions of the partial structures lying against this paint-free region. Due to the usually small spatial distances between the printed partial structures, the method of the invention also treats individual printed lines.

Treatment with electromagnetic radiation and/or with soundwaves of the region that has the two partial structures that are slightly separated from one another has the effect of reducing the viscosity of the paint in this region. This changed viscosity of the paint preferably is local and temporary. The changing of the viscosity of the paint is accompanied by an adaptation of the flow behavior of the paint in the treated region, and can cause the paint to run, or to run better, along the margins of two partial structures separated by a gap. Thus, the gap is closed. More particularly, the subsequent treatment with electromagnetic and/or acoustic radiation can cause the two spatially separated partial structures of the printed pattern to be brought together along their adjacent margins. The flow behavior of the paint of the printed pattern may be chosen such that, without the treatment, the paint would scarcely flow, or not flow at all, in the marginal region of the partial structures, and consequently the spatial separation would be maintained. The viscosity of the paint used may be chosen such that the paint can be printed onto surfaces that are not level and/or are sloping, and at the same time do not flow of their own accord. It is only the local and temporary subsequent treatment by electromagnetic and/or acoustic waves that brings about a "softening" of the margins of the printed partial structures to close the joints and produce a uniform printed pattern.

Paints that do not comprise solvents to bring about easier flowing of the paint after it has been applied to the surface can be used within the scope of the method described here.

The treatment of the at least one region may take place at the same time as the printing operation or during it. In this case, the irradiated region may be directly adjacent to the current printed region, or there may be a distance between the two locations that may be dependent on numerous parameters such as the printing speed, paint thickness, paint drying time, etc., and may be set suitably. The current printed region may be understood as meaning a region of the surface at which paint is applied to the surface by means of a printhead at the point in time under consideration. The method may be carried out such that the area within the treated region that is irradiated by the corresponding radiation source is adjusted correctively to the current printed region. Thus, a paint-free region lying between two partial structures can be treated together with adjacent margins of paint as soon as the second partial structure or second line has been applied by the printhead. The irradiated area within the treated region may be adjusted correctively to the current printed region in a continuously adapted manner. For this purpose, the electromagnetic and/or acoustic radiation source may be adjusted correctively to a printhead of a printer.

The electromagnetic waves may lie in the UV range and/or IR range. The irradiation with electromagnetic waves can generally lead to a thermal or optical excitation of the paint. The irradiation with soundwaves may be understood as a mechanical excitation of the paint in the treated region and be illustrated for instance by the effect of a microscopic vibration plate.

The paint that forms the printed pattern may comprise at least first color particles and/or additive particles. The color particles may determine the color of the paint. The wavelength of the electromagnetic waves may be chosen such that the color particles and/or the additive particles are excited. The excitation by electromagnetic radiation may be an optical or thermal excitation of the particles and/or of the additive particles. The additive particles may be additional particles that are added to the paint for a good input of energy into the paint. Thus, the additive particles in the paint may be irradiated by electromagnetic radiation appropriate for them, and thus with the overall effect that the paint can be heated up.

The first partial structure and the second partial structure may in each case be a strip. The strips may be printed in lines, where a printed line may correspond to a strip. By printing on a multiplicity of strips arranged close together, the regions where they join can be brought together by the subsequent treatment, and thus printed patterns of any sizes desired can be produced.

The invention further is directed to a device for printing a surface with a printed pattern. The device comprises a printhead and an application head. The application head may comprise a first emitting device and a second emitting device. The first emitting device may be set up for emitting electromagnetic waves and the second emitting device may be set up for emitting soundwaves. The device may be used for carrying out the printing method of the invention.

The application head may be arranged on the printhead. The application head may be arranged laterally on the printhead to irradiate a region close behind the current printed region during a printing operation. Similarly, the application head may be fastened on the printhead at a distance from the printhead so that the path of movement of the application head is coupled to the path of movement of the printhead.

The features mentioned above and those still to be explained below can be used not only in the combination that is respectively specified, but also in other combinations or on their own without departing from the scope of the invention.

DETAILED DESCRIPTION

Figure 1:
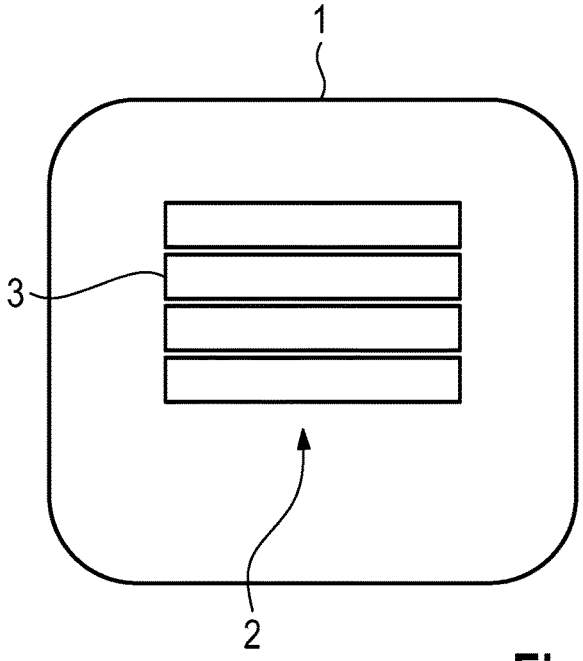
FIG. 1 shows a schematic representation of a printed pattern made up of individual partial structures.

FIG. 1 illustrates a component 1, on which a schematic printed pattern 2 is arranged. The printed pattern 2 comprises individual partial structures in the form of printed strips 3 that are arranged close together. Free spaces are arranged between the printed strips 3 to illustrate that the printed strips 3 are not printed right up against one another during the printing but at small distances from one another. It is usually attempted to choose the viscosity of the paint such that the paint runs or flows a little at the margins of the printed strips, and as a result the free spaces are closed.

Figure 2:
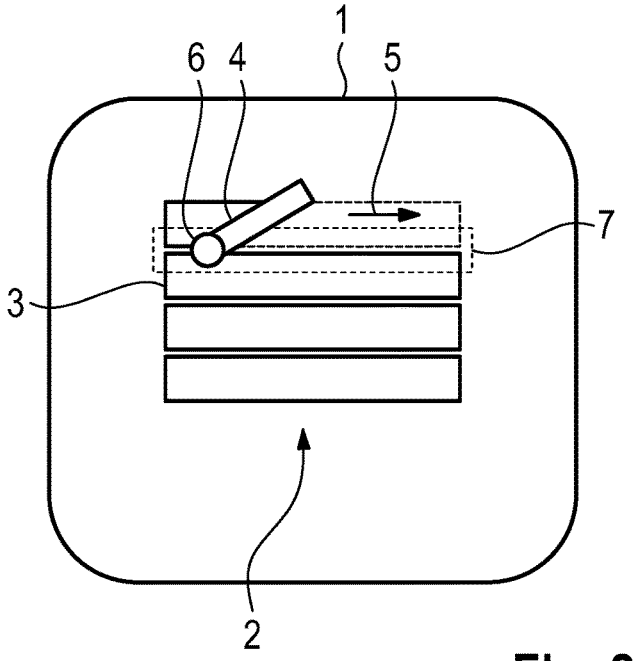
FIG. 2 shows a schematic representation of a printing operation according to the invention that is given by way of example.

FIG. 2 illustrates an embodiment of the printing method according to the invention on the basis of the printed pattern 2 shown in FIG. 1. The individual printed strips 3 are printed by a printhead 4, which by way of example has a rectangular form here. The printhead 4 in this case is moved from left to right in a printing direction indicated by the arrow 5 and applies the strips 3 in series from the bottom upward. A treated region 7 is shown between the uppermost printed strip 3 and the one arranged under it. The treated region 7 comprises at least the region between the two printed strips 3 and also includes marginal regions of the two printed strips 3. The treated region 7 may be treated expediently during the printing of the uppermost printed strip 3 by an application head 6 that is arranged behind the printhead 4 with respect to the direction of movement 5 of the printhead 4 so that the application head 6 is taken along during the printing. Consequently, the treatment in the treated region 7 takes place in a continuously incrementally adapted manner from one side to the other of the treated region 7. More particularly, as soon as a second line of paint is applied by the printhead 4, the joint between the lines can be treated by means of the application head 6, so that the paint in the treated region 7 can run better.

To illustrate the functional principle of the method according to the invention, the lowermost three printed strips in FIG. 2 are arranged at a distance from one another, although the free spaces between these three printed strips 3 are closed or covered with paint, since corresponding treated regions have already been irradiated with electromagnetic radiation and/or with ultrasound.

What is claimed is:

1. A method for printing a surface with a printed pattern, comprising:

moving a printhead in a printing direction along the surface for printing a first partial structure of the printed pattern on the surface, and then;

moving the printhead in the printing direction along the surface for printing a second partial structure of the printed pattern on the surface at a distance from the first printed structure in a direction perpendicular to the printing direction so that an unprinted region is defined on the surface between the first partial structure and the second partial structure;

moving an application head with the printhead so that the application head moves parallel to the unprinted region between the first partial structure and the second partial structure and so that the application head always is at a position in the printing direction that aligns with areas of the surface that already have the first and second partial structures printed thereon; and operating the application head for treating the unprinted region between the first partial structure and the second partial structure as well as areas of the first and second partial structures adjacent the unprinted region by irradiating the unprinted region and the adjacent areas of the first and second partial structures with electromagnetic waves and/or soundwaves, the treating with electromagnetic waves and/or soundwaves being carried out to reduce viscosity of the first and second partial structure adjacent the unprinted region sufficiently to join the first partial structure and the second partial structure and to cover the unprinted region.

2. The method of claim 1, wherein the step of operating the application head for treating the unprinted region takes place at the same time that the printhead is printing the second partial structure to an area of the surface forward of the application head in the printing direction.

3. The method of claim 1, wherein the electromagnetic waves are in the UV range and/or IR range.

4. The method of claim 1, wherein the printing of the first partial structure and the second partial structure comprises applying at least color particles and additive particles; and wavelengths of the electromagnetic waves are selected for reducing a viscosity of the color particles and/or the additive particles sufficiently to join the first partial structure and the second partial structure and to cover the unprinted region.

5. The method of claim 1, wherein the first partial structure and the second partial structure are strips.

6. The method of claim 1, wherein the first partial structure is applied to a first surface region and the second partial structure is applied to a second surface region, the first and second partial structures have viscosities selected to prevent the first and second partial structures from flowing together before irradiating the region with electromagnetic waves and/or soundwaves.

7. The method of claim 6, wherein the second region is not level with the first region.

8. The method of claim 1, further comprising printing at least a third partial structure of the printed pattern at a distance from the second partial structures and on a side of the second partial structure opposite the first partial structure so that a second unprinted region is defined on the surface between the second partial structure and the third partial structure;

moving the application head with the printhead so that the application head moves parallel to the second unprinted region between the second partial structure and the third partial structure and so that the application head always is at a position in the printing direction that aligns with areas of the surface that already have the second and third partial structures printed thereon; and operating the application head for treating the second unprinted region between the second partial structure and the third partial structure as well as areas of the second and third partial structures adjacent the second unprinted region by irradiating the second unprinted region and the adjacent areas of the second and third partial structures with electromagnetic waves and/or soundwaves, the treating of the second unprinted region with electromagnetic waves and/or soundwaves being carried out to reduce viscosity of the second and third partial structure adjacent the unprinted region sufficiently to join the second partial structure and the third partial structure and to cover the second unprinted region.

9. The method of claim 1, wherein the surface is a surface of a vehicle body.

10. The method of claim 1, wherein the surface is a surface of an automobile hood.

* * * * *